United States Patent [19]

Nakanishi et al.

[11] Patent Number: 4,920,379

[45] Date of Patent: Apr. 24, 1990

[54] IMAGE FORMING APPARATUS WITH A COMMON POWER SOURCE FOR VARIOUS CHARGERS AND A SIMPLIFIED ARRANGEMENT FOR SUBJECTING THE PHOTOSENSITIVE DRUM TO BLANK EXPOSURE

[75] Inventors: Yasushi Nakanishi, Yamatokoriyama; Takahiro Fukunaga; Manabu Matsumoto, both of Nara, all of Japan

[73] Assignee: Sharp Kabushiki Kaisha, Osaka, Japan

[21] Appl. No.: 359,276

[22] Filed: May 31, 1989

[30] Foreign Application Priority Data

May 31, 1988 [JP] Japan ..... 63-135123

[51] Int. Cl.[5] ..... G03G 13/00; G03G 15/00

[52] U.S. Cl. ..... 355/210; 355/234; 355/233; 355/219; 355/218

[58] Field of Search ..... 355/219, 220, 234, 271, 355/210, 218, 221, 230

[56] References Cited

U.S. PATENT DOCUMENTS 4,080,071 3/1978 Kobayashi ..... 355/230 X
4,552,447 11/1985 Sagara et al. ..... 355/218
4,743,947 5/1988 Yamamoto ..... 355/218

FOREIGN PATENT DOCUMENTS 0157759 12/1980 Japan ..... 355/219
0174779 6/1987 Japan ..... 355/219

*Primary Examiner*—A. T. Grimley
*Assistant Examiner*—Nestor R. Ramirez
*Attorney, Agent, or Firm*—Flehr, Hohbach, Test, Albritton & Herbert

[57] ABSTRACT

An image forming apparatus with a main body composed of a light source, a photoreceptor, charging device for electrostatically a charging the surface of the photoreceptor, a developing device for supplying toner particles to the surface of the photoreceptor a transferring charger for transferring a toner image formed on the surface of the photoreceptor onto a copying sheet, and a high-voltage source for applying a high voltage trigger to both said charging device and the transferring charger simultaneously. The apparatus is designed to execute original scanning as an original glass plate is moved with respect to the main body, characterized in containing a reflecting unit for reflecting the light from the light source to illuminate the surface of the photoreceptor at an area between the charging device and the developing device, the reflecting unit is disposed at a position corresponding to the trailing end of the original glass plate in its forward movement for original scanning. The apparatus is designed to eliminate the need of providing an independent light source for blank exposure thereby simplifying the arrangement for blank exposure to be performed with respect to the photoreceptor and saving the manufacturing cost for the apparatus.

4 Claims, 5 Drawing Sheets

IMAGE FORMING APPARATUS WITH A COMMON POWER SOURCE FOR VARIOUS CHARGERS AND A SIMPLIFIED ARRANGEMENT FOR SUBJECTING THE PHOTOSENSITIVE DRUM TO BLANK EXPOSURE

FIELD OF THE INVENTION

This invention relates to an image forming apparatus, such as an electrostatic coping apparatus or the like and, more particularly, to an image forming apparatus wherein a high voltage trigger is applied to a charging device and to a transferring device simultaneously by a common high-voltage transformer to the both devices.

BACKGROUND OF THE INVENTION

Hitherto, there has been known an electrostatic copying apparatus of the type in which, with the aim of machine compacturization and otherwise, it is arranged that a high voltage trigger is applied to an electrostatic charger and to an image transferring charger by a common high-voltage trasnformer.

Generally, in electrostatic copying apparatuses, the process of copying is carried out in such a way that the surface of a photoreceptor to which an electrostatic charge is applied by an electrostatic charger is exposed to a light image of an original so that an electrostatic latent image is formed on the surface of the photoreceptor; and in a subsequent developing stage the electrostatic latent image is developed into a toner image which, in turn, is transferred onto a copying sheet as an image transferring charger is actuated into operation in the stage of image transferring.

In this way, it is required that after an electrostatic latent image has been formed on the photoreceptor, the transferring charger be actuated in the transferring stage which follows the stage of developing. Therefore, in the electrostatic copying apparatuses of the above mentioned arrangement wherein a high voltage trigger is applied to both the electrostatic charger and the transferring charger simultaneously by the common high-voltage transformer, electrostatic discharge from the electrostatic charger is continued even during the stage of image trasferring.

In other words, a non-image area located behind an image area in which the electrostatic latent image has been formed in continuously subjected to electrostatic charging by the electrostatic charger.

Therefore, in order to prevent toner particles fed from a developing device from adhering to the electrostatically charged non-image area, it is necessary to subject the non-image area to the step of so-called blank exposure thereby to remove the charge from the non-image area. Such blank exposure is also executed prior to the formation of an electrostatic latent image in each copying cycle for purposes of removing a residual charge in the previous copying cycle and otherwise.

Now, an electrostatic copying apparatus has been proposed which has a movable shutter adapted to be inserted into and retracted from an optical path between an original and a photoreceptor, whereby the movable shutter is inserted into the optical path during the stage of blank exposure so that it operates to cause a beam of light from a light source to be reflected toward the surface of the photoreceptor, the charge on the photoreceptor surface being thereby removed (see Japanese Patent Application Laid-Open Publication No. 54-58447). This arrangement eliminates the necessity of providing an independent source of light for blank exposure.

According to the arrangement of such a copying apparatus, it may be possible to utilize the movable shutter when a high voltage trigger is applied to both the electrostatic charger and the image transferring charger by the common high-voltage transformer, so that a beam of light from the light source is projected onto the surface of the photoreceptor through the movable shutter in order to remove the charge applied to the surface of the photoreceptor by the electrostatic charger during the stage of image transferring.

The use of such movable shutter eliminates the need for an independent light source for blank exposure. On the other hand, however, the trouble is that since the movable shutter itself is rather complicated in construction, the provision of the movable shutter complicates the construction of the image forming apparatus, and further entails an increase in manufacturing cost.

SUMMARY OF THE INVENTION

It is an object of the invention to provide an image forming appratus which has a simplified arrangement for subjecting the photoreceptor to blank exposure and which can be manufactured at a low cost.

Aforesaid blank exposure is executed for the purpose of removing the electrostatic charge which is applied to the non-image area of the surface of the photoreceptor by an electrostatic charging means after the end of the stage of document scanning and until the end of the stage of toner image transferring. Such blank exposure is also carried out to remove the charge which is applied to the non-image area of the photoreceptor surface by the electrostatic charging means for the purpose of cleaning the photoreceptor prior to the start of document scanning.

It is another object of the invention to provide an image forming apparatus in which accurate detection can be made of the completion of transfer onto a copying sheet of a toner image formed on the surface of the photoreceptor and in which blank exposure can therefore be properly executed.

It is a further object of the invention to provide an image forming apparatus in which an original glass plate is prevented from being controlled not so as to move in the return direction when the original glass plate is still in the movement in the feed direction because of some delay in the action of a solenoid for controlling the movement of the original glass plate or because of an inertia force acting on the original glass plate, any part of the apparatus being thus positively prevented from being damaged.

In order to accomplish aforesaid objects, the image forming apparatus comprising, in a main body thereof, a light source, a photoreceptor, charging means for electrostatically charging the surface of the photoreceptor, developing means for supplying toner particles to the surface of the photoreceptor, transferring means for transferring onto a copying sheet a toner image formed on the surface of the photoreceptor, and high-voltage applying means for applying a high voltage trigger to both said charging means and said transferring means simultaneously, said apparatus being designed to execute original scanning as an original glass plate is moved with respect to said main body, is characterized in comprising a reflecting unit for reflecting the light from the light source to illuminate the surface of the photoreceptor at an area between the charging means and the developing means, said reflecting unit being disposed at a position corresponding to the trailing end of the original glass plate in its forward movement for original scanning and control means for causing the original glass plate to stop at an original scanning completing station after the end of the original scanning until the end of the stage of image transferring by the transferring means and for causing the light source to continue light emission so that the charge which is applied to a non-image area of the photoreceptor surface after the end of the original scanning until the end of the stage of image transferring is removed by the light from the light source that is reflected by said reflecting unit to illuminate the surface of the phtoreceptor.

The image forming apparatus further comprises a paper detecting switch for detecting the presence or absence of a copying sheet, said switch being disposed in a traveling path of a copying sheet at a location before the station at which the toner image transferring is executed, and a timer for counting a period of time corresponding to the time involved after a copying sheet passes the position of said paper detecting switch until it passes the toner image transfer station said control means being adapted to cause the charge applied to the non-image area of the photoreceptor surface to be removed by the light from the light source until the timing up of said timer.

Said control means may be of such an arrangement that if, at the end of the stage of toner image transferring onto the copying sheet, a predetermined time has not elapsed after the original glass plate is stopped, the predetermined time is allowed to elapse so that the original glass plate is caused to return to its predetermined position after the original glass plate is definitely stopped.

In another embodiment, the image forming apparatus comprising, in a main body thereof, a light source, a photoreceptor, charging means for electrostatically charging the surface of the photoreceptor, developing means for supplying toner particles to the surface of the photoreceptor, transferring means for transferring onto a copying sheet a toner image formed on the surface of the photoreceptor, and high-voltage applying means for applying a high voltage trigger to both said charging means and said transferring means, said apparatus being designed to execute original scanning as an original glass plate is moved with respect to said main body, is characterized in comprising a reflecting unit for reflecting the light from the light source to illuminate the surface of the photoreceptor at an area between the charging means and the developing means, said reflecting unit being disposed at a position corresponding to the leading end of the original glass plate in its forward movement for original scanning, and control means for causing the original glass plate to stop at an original scanning starting station prior to the start of the original scanning and for causing the light source to emit light so that the charge which is applied to a non-image area of the photoreceptor surface until the start of the original scanning is removed by the light from the light source that is reflected by said reflecting unit to illuminate the surface of the photoreceptor, thereby cleaning the photoreceptor.

DESCRIPTION OF THE EMBODIMENTS

One embodiment of the invention will now be described with reference to FIGS. 1 through 5.

Figure 3:
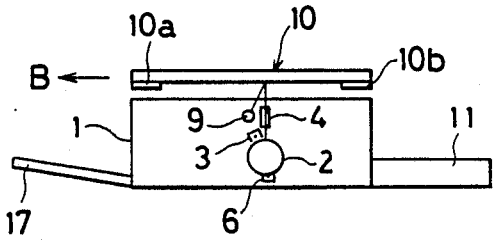
FIG. 3 (*a*) to 3 (*e*) are explanatory views illustrating the movement of an original glass plate in the course of copying operation.
Figure 3:
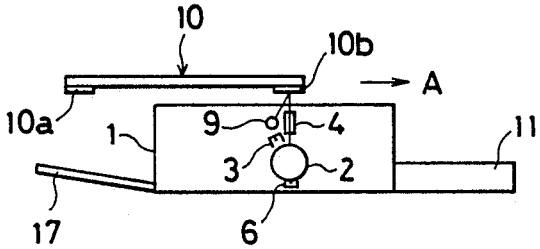
Figure 3:
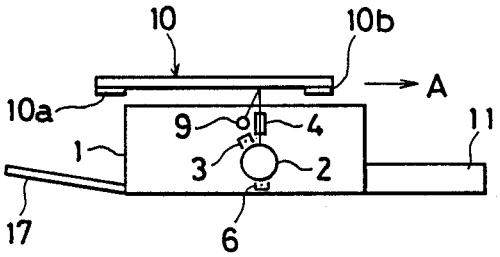
Figure 3:
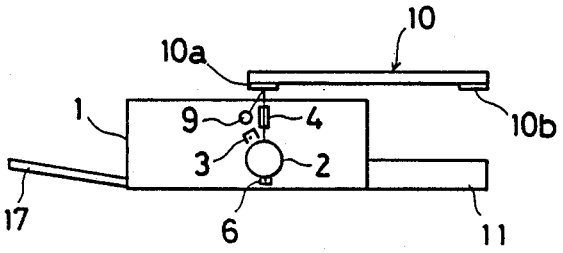
Figure 3:
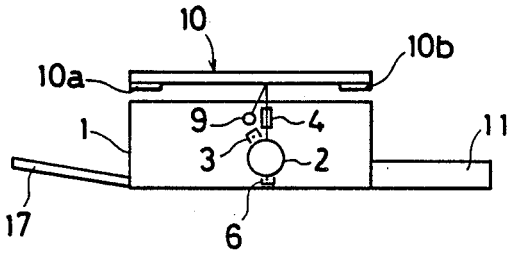
Figure 4:
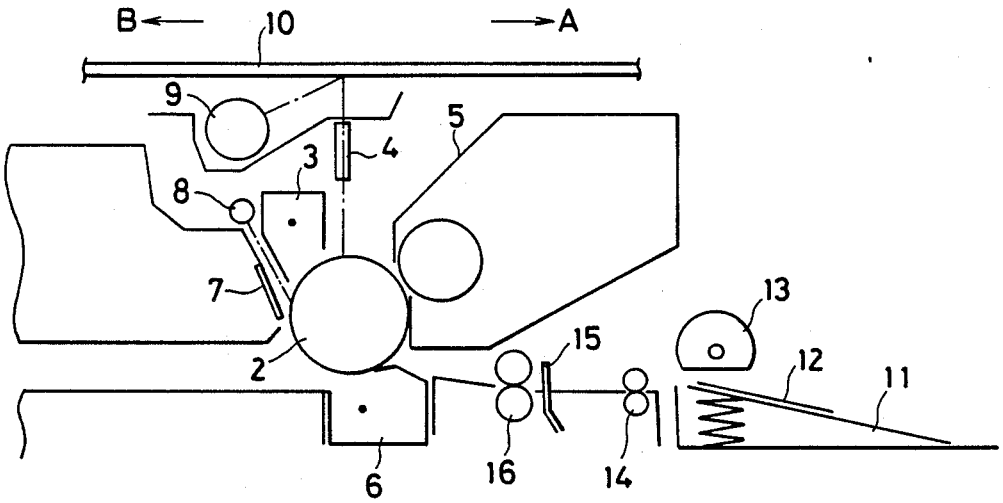
FIG. 4 is an explanatory view showing the internal arrangement of a copying apparatus.

An electrostatic copying apparatus as an image forming apparatus, as FIGS. 3 (*a*) to 3 (*e*), and 4 show, includes a main body 1 of the copying apparatus or image forming apparatus. A photoreceptor drum 2 is disposed within the main body 1 of the copying apparatus. The photoreceptor drum 2 is driven by a main motor MM not shown to rotate in the clockwise direction in FIGS. 3 and 4. Disposed around the photoreceptor drum 2 are an electrostatic charger 3 as electrostatic means, a Selfoc lens 4, a developing device 5 as developing means, a transferring charger 6 as transferring means, a cleaning device 7, and a charge removing lamp 8. An exposure lamp 9 as a light source is disposed above the charge removing lamp.

An original glass plate 10 is supported above the main body 1 of the copying apparatus so as to move in a feed direction which is the moving direction of the original glass plate 10 during a scanning operation (the direction of arrow A) and also in a return direction (the direction of arrow B).

At the rear end of the original glass plate 10 oriented in the feed direction, there is mounted, on the underside thereof, a first white reflecting plate 10(*a*) as a reflecting unit which reflects the light from the exposure lamp 9 to direct same toward an area between the electrostatic charger 3 and the developing device 5 in the photoreceptor drum 2 through the Selfoc lens 4 when the original glass plate 10 is positioned at an overrun position (FIG. 3 (*d*)) where its movement in the feed direction is terminated.

At the leading end of the original glass plate 10, oriented in the feed direction, there is mounted, on the underside thereof, a second white reflecting plate 10*b* which reflects the light from the exposure lamp 9 to direct same toward the area between the electrostatic charger 3 and the developing device 5 in the photoreceptor drum 2 through the Selfoc lens 4 when the original glass plate 10 is positioned at a start position (FIG. 3 (*d*)) where its movement in the return direction is terminated.

On the original glass plate 10 there are disposed, a home position sensor HPS for detecting the original glass plate being at its home position, a start position sensor SPS for detecting the original glass plate 10 being at the start position (FIG. 3 (*b*)), and an overrun position sensor OPS for detecting the original glass plate 10 being at the overrun position (FIG. 3(*d*)). These sensors are not shown in the drawings.

A paper storing member 11 is disposed at one side of a lower portion of the main body 1 of the copying apparatus so that copying sheets 12 housed in the paper storing member 11 are successively supplied, one by one, by means of a feed roller 13 during the process of copying. Each sheet 12 fed through the feed roller 13 is supplied to a paper stop roller 16 (hereinafter referred to as PS roller) through an incoming paper detecting switch (PIS) 15 for detecting the supply of the sheet 12 to the photoreceptor drum 2. The PS roller 16 supplies the sheet 12 to the photoreceptor drum 2 by such timing as is synchronous with the transfer of a toner image from the photoreceptor drum 2.

A fixing device not shown is disposed at the other side of the lower portion of the main body 1 of the copying apparatus, and a paper discharge tray 17 is disposed in adjoining relation to the fixing device and in the exterior of the main body 1 of the copying apparatus. Further, an outgoing paper detecting switch POS, not shown, for detecting discharge of the copying sheet 12 to the discharge tray 17 is disposed in the main body 1 of the copying apparatus.

Figure 5:
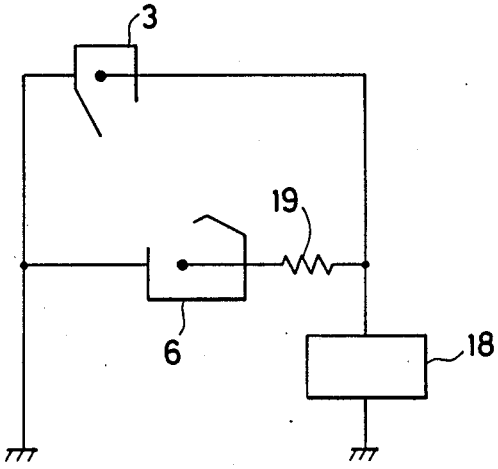
FIG. 5 is a circuit diagram showing a high voltage system which applied a high voltage trigger to both an electrostatic charger and an image transferring charger.

As FIG. 5 shows, the electrostatic charger 3 is connected to a high voltage transformer 18 as high voltage application means, and the transferring charger 6 is connected through a resistor 19 to the high voltage transformer 18 so that a high voltage trigger is applied from the high voltage transfomer 18 simultaneously to both the electrostatic charger 3 and the transferring charger 6. Above mentioned components which are housed in the main body 1 of the copying apparatus are controlled by control means, not shown, such as a microcomputer or the like.

Next, the manner of the operation of the copying apparatus will be explained.

In a copying operation, the original glass plate 10 supporting an original not shown is first moved from the home position (FIG. 3 (*a*)) to the start position (FIG. 3 (*b*)). Thereafter, the original glass plate 10 is moved in the feed direction as the surface of the photoreceptor drum 2 is charged by the electrostatic charger 3 to a predetermined potential, whereby the original is scanned by the exposure lamp 9 (FIG. 3 (*c*)). Accordingly, a beam of light reflected from the original is projected on to the surface of the photoreceptor drum 2 through the Selfoc lens 4 so that an electrostatic latent image is formed on the surface of the photoreceptor drum 2. Subsequently, the electrostatic latent image is developed by toner particles supplied form the developing device 5, a toner image being thus formed on the surface of photoreceptor drum 2.

This is followed by supply of the copying sheet 12 from the PS roller 16 to the photoreceptor drum 2, and then the toner image on the surface of the photoreceptor drum 2 is transferred onto the copying sheet 12 by electrostatic discharge from the transferring charger 6. During this transfer operation, the original glass plate 10 is caused to stop at the overrun position shown in FIG. 3 (*d*) by the control means. A beam of light from the exposure lamp 9 is reflected by the white reflecting plate 10*a* to illuminate the photoreceptor drum 2 so that the charge applied by the electrostatic charger 3 to the surface of the photoreceptor drum 2 is removed even during the period of toner image transferring.

Upon completion of the transfer operation, the original glass plate 10 is caused to return to the home position (FIG. 3 (*e*)), and at the same time the sheet 12 is transported to the fixing device in which image fixation is carried out. Thereafter, the sheet 12 is discharged onto the discharge tray 17. Any residual toner present on the surface of the photoreceptor drum 2 is removed by the cleaning device 7, while any residual charge on the surface of the photoreceptor drum 2 is removed by a beam of light projected from the charge removing lamp 8.

The controlling procedures during the process of copying will now be described in detail with reference to FIGS. 1 and 2. For the convenience of explanation, step numbers corresponding to the steps in the flow chart of FIG. 2 are given at the top of the time chart of FIG. 1.

Figure 2:
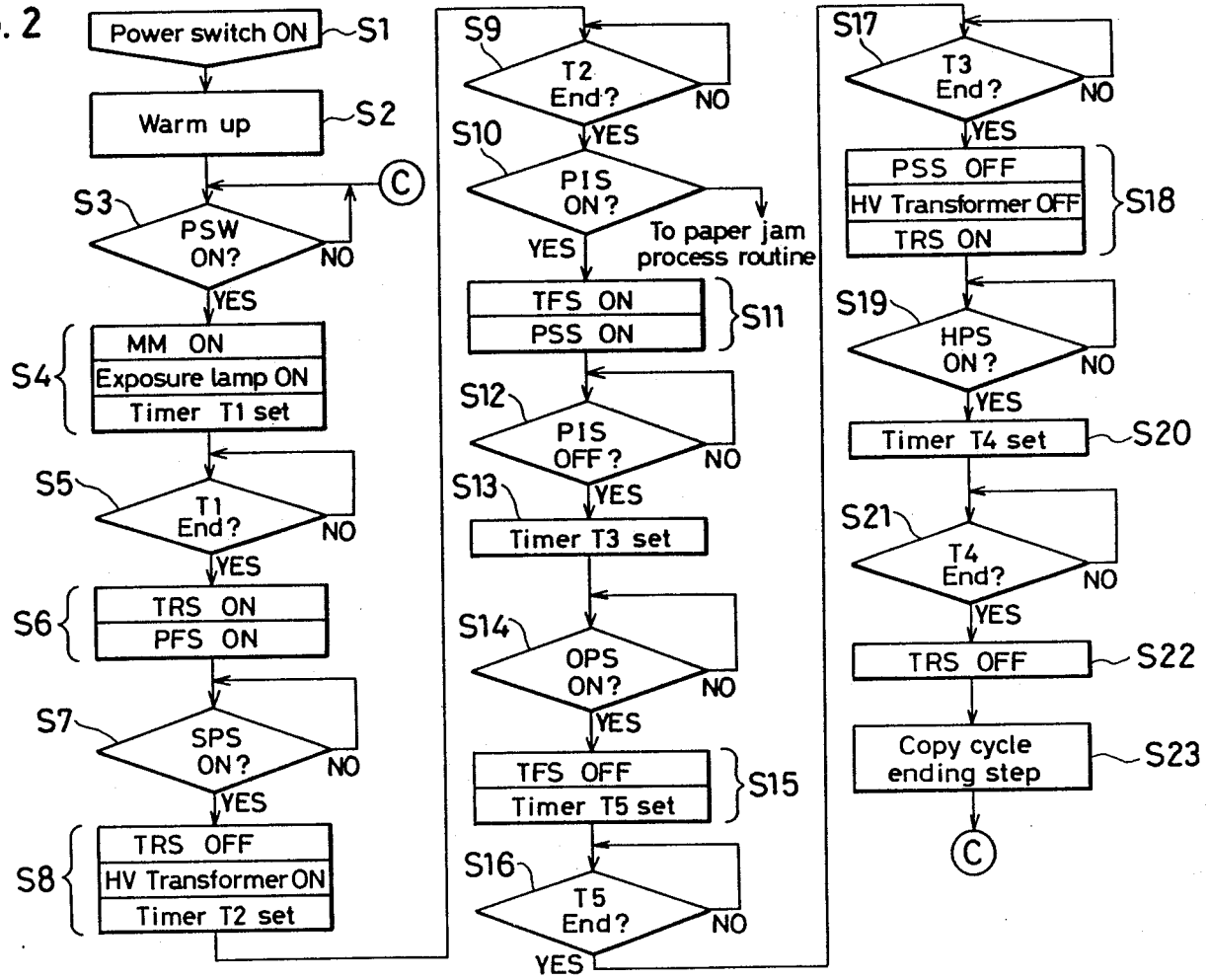
FIG. 2 is a flow chart showing the controlling procedures during copying operation.

In the flow chart of FIG. 2, when a power supply not shown is turned on (S1), warming up, e.g., heating, of the fixing device is executed (S2), and a standby period follows (S3) until a print switch PSW, not shown, is turned on to command a copying operation.

Figure 1:
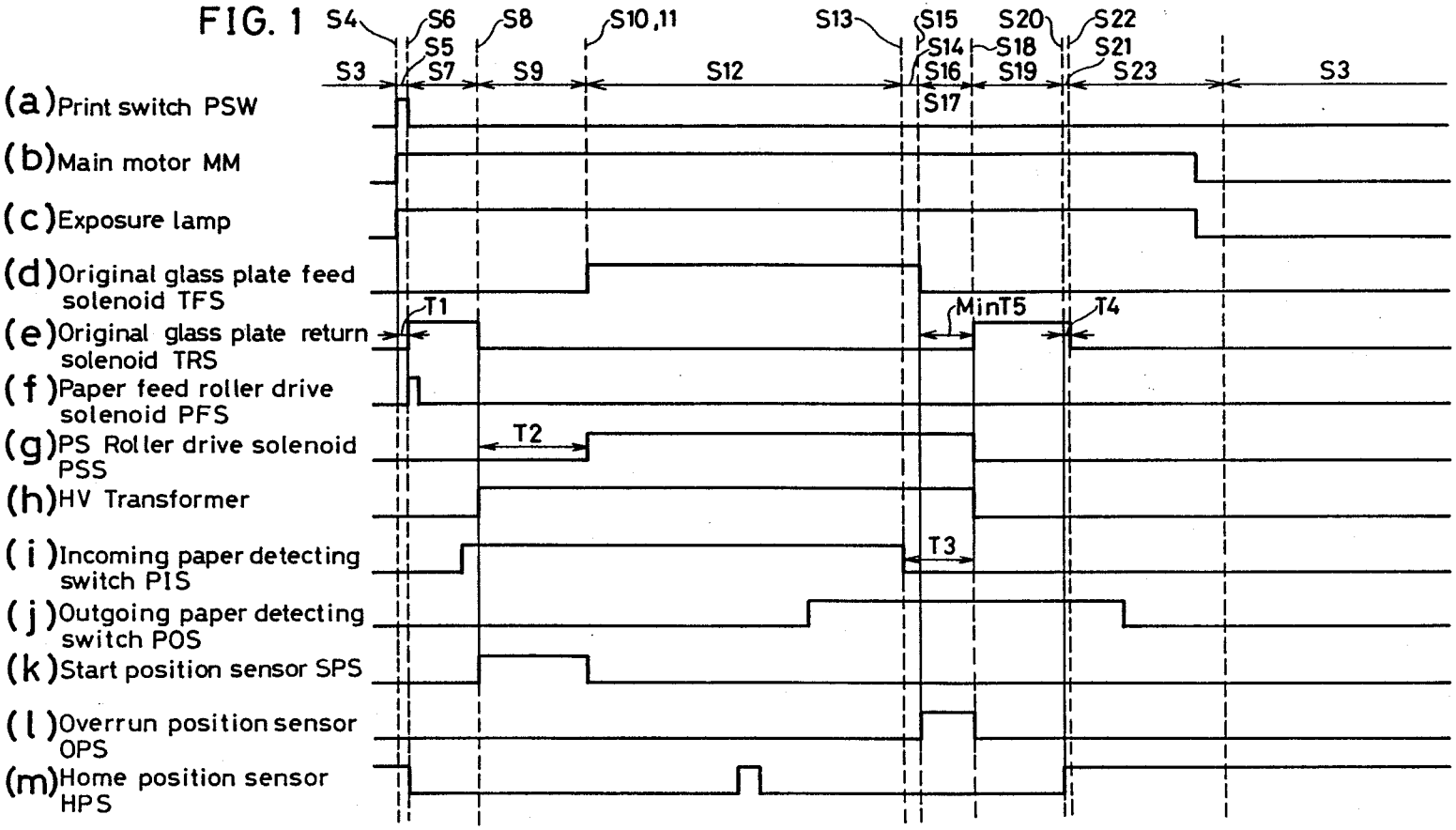
FIG. 1 is a time chart showing the controlling procedures during copying operation.

When the print switch PSW is turned on (FIG. 1 (*a*)), the main motor MM and the exposure lamp 9 are turned on (FIGS. 1 (*b*) and 1 (*c*)) and a timer T1 is set (S4).

Subsequently, decision is made whether the time T1 has ended its counting operation or not (S5). If it is determined that counting operation by the timer T1 has ended, an original glass plate return solenoid TRS not shown is turned on (FIG. 1 (*e*)) and accordingly a clutch between a drive mechanism for the original glass plate 10 and the main motor MM is connected, so that the movement of the original glass plate 10 in the return direction(B direction) is commenced and simultaneously a paper feed roller driving solenoid PFS not shown is turned on (FIG. 1 (*f*)), power being thus transmitted to the paper feed roller 13 so that the copying sheet 12 is fed from the paper storing member 11 (S6).

Then, a standby period follows until the start position sensor SPS is turned on (S7). When the start position sensor SPS is turned on (FIG. 1 (*k*)), the original glass plate return solenoid TRS is turned off, whereupon the movement of the original glass plate 10 is terminated so that the glass plate 10 stops at the start position. Simultaneously, the high voltage transformer 18 is turned on so that application of a high voltage trigger to the electrostatic charger 3 and transferring charger 6 is commenced (FIG. 1 (*h*)) and a timer T2 is set (S8).

Then, a standby period follows until the timer T2 ends its counting operation (S9). During this standby period, corona discharge from both the electrostatic charger 3 and the transferring charger 6 is applied to the photoreceptor drum 2. The charge applied to the surface of the photoreceptor drum 2 by the electrostatic charger 3 is removed as the light from the exposure lamp 9 is reflected by the white reflecting plate 10*b* on the original glass plate 10 to illuminate the photoreceptor drum 2 through the Selfoc lens 4. The charge applied to the photoreceptor drum 2 by the transferring charger 6 is removed by a beam of light from the charge removing lamp 8.

At aforesaid steps S8 and S9, cleaning of the photoreceptor drum 2 is carried out. This cleaning operation may be carried out during the period of warming up at step S2.

Thereafter, when counting operation by the timer T2 is terminated, decision is made whether or not the sheet 12 has passed the incoming paper detecting switch (PIS) 15 thereby turning on the incoming paper detecting switch (PIS) 15 (S10). If it is determined that the incoming paper detecting switch 15 is not ON, decision is made that a paper jam has been caused, and the program advances to a paper jam handling routine.

If, on the other hand, the incoming paper detecting switch 15 is ON (FIG. 1 (*i*)), decision is made that there is no paper jam, whereupon an original glass plate feed solenoid TFS, not shown, is turned on to start power transmission for moving the original glass palte 10 in the feed direction and, simultaneously, a PS roller driving solenoid PSS, not shown, is turned on to transmit power to the PS roller 16 (FIGS. 1 (*d*), 1 (*g*)) (S11). Accordingly, the original glass plate 10 is moved in the feed direction via the home position for an original scanning operation and, at the same time, the sheet 12 is supplied from the PS roller 16 onto the photoreceptor drum 2.

As original scanning carried out, an electrostatic latent image is formed on the surface of the photoreceptor drum 2 as already mentioned, the electrostatic latent image is sequentially developed by toner particles fed from the developing device 5.

Subsequently, decision is made whether or not the trailing end of the sheet 12 has left the incoming paper detecting switch 15 with the result that the (PIS) 15 has been turned off (S12). If it is determined that the incoming paper detecting switch 15 is off, a timer T3 is set for counting the time required up to the end of transfer operation (S13) and then decision is made whether or not the overrun position sensor OPS has been turned on (S14).

If it is determined that the overrun position sensor OPS is ON (FIG. 1 (*l*)), the original glass plate feed solenoid TFS is turned off so that the original glass plate 10 is stopped at the overrun position, and simultaneously a timer T5 is set (S15). This standby time setting by the timer T5 is set to prevent the start of movement of the original glass plate 10 in the return direction when the original glass plate 10 is still moving in the feed direction of feed because of some delay in the turning off action of the original glass plate feed solenoid TFS or under an inertia force of the original glass plate 10.

When the original glass plate 10 has reached the overrun position to complete the scanning of the original and the formation of a toner image through development of the electrostatic latent image, the toner image is transferred, by corona discharge from the transferring charger 6, onto copying the sheet 12 fed to the photoreceptor drum 2.

During this stage of image transferring, there is still continued supply of a high voltage trigger to both the electrostatic charger 3 and the transferring charger 6 by the common high voltage transformer, and therefore the photoreceptor drum 2 is naturally subjected to the application of corona charge from the electrostatic charger 3. As mentioned above, however, in the stage of image transferring, the original glass plate 10 stays at the overrun position and there is continued emission of light from the exposure lamp 9; therefore, the light from the exposure lamp 9 is reflected by the white reflecting plate 10*a* on the original glass plate 10 to illuminate the photoreceptor drum 2 over its area between the electrostatic charger 3 and the developing device 5 through the Selfoc lens 4, so that the charge which is applied to the non-image area of the photoreceptor drum 2 by the electrostatic charger 3 during the transferring stage is effectively removed.

Subsequently, decision is made whether or not the timer T5 has completed its counting operation. If it is determined that the counting by the timer T5 is completed, then decision is made whether or not the timer T3 has completed its counting operation (S17). If the timer T3 has completed the counting, it is considered what the stage of transfer has been ended, and accordingly the PS roller drive solenoid PSS is turned off to terminate the rotation of the PS roller 16 and the application of high voltage trigger to both the electrostatic charger 3 and the transferring charger 6 by the high voltage transformer 18 is discontinued. Further, the original glass plate return solenoid TRS is turned on to cause the original glass palte 10 to start its movement in the feed direction (S18).

Then, decision is made whether or not the home position sensor HPS has been turned on (S19). If it is determined that the original glass plate 10 has returned to the home position, the home position sensor HPS being thus turned on (FIG. 1 (*m*)), a timer T4 is set (S20). Thereafter, when the timer T4 ends counting operation (S21), the original glass plate return solenoid TRS is turned off to terminate the movement of the original glass plate 10 (S22); and a step is taken for copy cycle ending (S23), the program then returning to step S3.

As described above, the image forming apparatus according to the invention which comprises, in a main body thereof, a light source, a photoreceptor, charging means for electrostatically charging the surface of the photoreceptor, developing means for supplying toner particles to the surface of the photoreceptor, transferring means for transferring onto a copying sheet a toner image formed on the surface of the photoreceptor, and high-voltage applying means for applying a high voltage trigger to both said charging means and said transferring means simultaneously, said apparatus being designed to execute original scanning as an original glass plate is moved with respect to said main body, is characterized in comprising a reflecting unit for reflecting the light from the light source to illuminate the surface of the photoreceptor at an area between the charging means and the developing means, said reflecting unit being disposed at a position correcponding to the trailing end of the original glass plate in its forward movement for original scanning, and control means for causing the original glass plate to stop at an original scanning completing station after the end of the original scanning until the end of the stage of image transferring by the transferring means and for causing the light source to continue light emission so that the charge which is applied to a non-image area of the photoreceptor surface after the end of the original scanning until the end of the stage of image transferring is removed by the light from the light source that is reflected by said reflecting unit to illuminate the surface of the photoreceptor.

The image forming apparatus further comprises a paper detecting switch for detecting the presence or absence of a copying sheet, said switch being disposed in a traveling path of a copying sheet at a location before the station at which the toner image transferring is executed, and a timer for counting a period of time corresponding to the time involved after a copying sheet passes the position of said paper detecting switch until it passes the toner image transfer station said control means being adapted to cause the charge applied to the non-image area of the photoreceptor surface to be removed by the light from the light source until the timing up of said timer.

Said control means may be of such an arrangement that if, at the end of the stage of toner image transferring onto the copying sheet, a predetermined time has not elapsed after the original glass plate is stopped, the predetermined time is allowed to elapse so that the original glass plate is caused to return to its predetermined position after the original glass plate is definitely stopped.

In another embodiment, the image forming apparatus comprising, in a main body thereof, a light source, a photoreceptor, charging means for electrostatically charging the surface of the photoreceptor, developing means for supplying toner particles to the surface of the photoreceptor, transferring means for transferring onto a copying sheet a toner image formed on the surface of the photoreceptor, and high-voltage applying means for applying a high voltage trigger to both said charging means and said transferring means, said apparatus being designed to execute original scanning as an original glass plate is moved with respect to said main body, is characterized in comprising a reflecting unit for reflecting the light from the light source to illuminate the surface of the photoreceptor at an area between the charging means and the developing means, said reflecting unit being disposed at a position corresponding to the leading end of the original glass plate in its forward movement for original scanning, and control means for causing the original glass plate to stop at an original scanning starting station prior to the start of the original scanning and for causing the light source to emit light so that the charge which is applied to a non-image area of the photoreceptor surface until the start of the original scanning is removed by the light from the light source that is reflected by said reflecting unit to illuminate the surface of the photoreceptor, thereby cleaning the photoreceptor.

According to the invention, as above described, a reflecting device for reflecting the light from the light source is disposed at the rear end of the original setting glass plate in the moving direction of the original glass plate during an original scanning operation, and it is arranged that the original glass plate stops at the scanning end position after the end of the scanning operation until the end of the image transferring operation by the transferring mean and that light emission from the light source is continued until the end of the transferring stage, so that after the end of the scanning operation until the end of the transferring operation, the light reflected from the reflecting device is directed toward the non-image area of the photoreceptor surface between the electrostatic charging means and the developing means, thereby removing, by the reflected light from the reflecting device, the charge applied to the non-image area of the photoreceptor surface by the electrostatic charging means, which continues to carry out corona discharge, in conjunction with the transfer means, even after the end of the scanning operation.

In this case, the reflecting device may be securely fixed on the original glass plate, there being no necessity of providing an independent light source for blank exposure. Therefore, where a common high voltage application means is employed for applying a high voltage trigger to both the electrostatic charging means and the transferring means, the arrangement necessary for blank exposure until the end of the transfer operation can be much more simplified than the prior art arrangement. Further, the arrangement of the invention makes it possible to manufacture the apparatus at a lower cost.

Further, in the image forming apparatus of the invention, the arrangement for blank exposure may be simplified, said blank exposure being executed for removing the charge which has been applied to the non-image area of the photoreceptor surface by the cleaning means so that cleaning of the photoreceptor prior to the start of an original scanning operation is performed.

Further, according to the invention, the completion of transferring a toner image formed on the photoreceptor surface onto a copying sheet is accurately detected thereby to achieve an accurate and precise blank exposure.

Further, it is possible to prevent the original glass plate from being controlled not so as to move in the return direction when the original glass plate is still moving in the feed direction due to a delay in solenoid action for controlling the movement of the original glass plate or due to the inertia force of the original glass plate, thereby to positively prevent the apparatus from being damaged or otherwise.

What is claimed is:

1. An image forming apparatus which comprises, in a main body thereof, a light source, a photoreceptor, charging means for electrostatically charging the surface of the photoreceptor, developing means for supplying toner particles to the surface of the photoreceptor, transferring means for transferring onto a copying sheet a toner image formed on the surface of the photoreceptor, and high-voltage applying means for applying a high voltage trigger to both said charging means and said transferring means simultaneously, said apparatus being designed to execute original scanning as an original glass plate is moved with respect to said main body, characterized in comprising a reflecting unit for reflecting the light from the light source to illuminate the surface of the photoreceptor at an area between the charging means and the developing means, said reflecting unit being disposed at a position corresponding to the trailing end of the original glass plate in its forward movement for original scanning, and control means for causing the original glass plate to stop at an original scanning completing station after the end of the original scanning until the end of the stage of image transferring by the transferring means and for causing the light source to continue light emission so that the charge which is applied to a non-image area of the photoreceptor surface after the end of the original scanning until the end of the stage of image transferring is removed by the light from the light source that is reflected by said reflecting unit to illuminate the surface of the photoreceptor.

2. An image forming apparatus according to claim 1, further comprising a paper detecting switch for detecting the presence or absence of a copying sheet, said switch being disposed in a traveling path of a copying sheet at a location before the station at which the toner image transferring is executed, and a timer for counting a period of time corresponding to the time involved after a copying sheet passes the position of said paper detecting switch until it passes the toner image transfer station said control means being adapted to cause the charge applied to the non-image area of the photoreceptor surface to be removed by the light from the light source until the timing up of said timer.

3. An image forming apparatus according to claim 1 wherein said control means is arranged such that if, at the end of the stage of toner image transferring onto the copying sheet, a predetermined time has not elapsed after the original glass plate is stopped, the predetermined time is allowed to elapse so that the original glass plate is caused to return to its predetermined position after the original glass plate is definitely stopped.

4. An image forming apparatus which comprises, in a main body thereof, a light source, a photoreceptor, charging means for electrostatically charging the surface of the photoreceptor, developing means for supplying toner particles to the surface of the photoreceptor, transferring means for transferring onto a copying sheet a toner image formed on the surface of the photoreceptor, and high-voltage applying means for applying a high voltage trigger to both said charging means and said transferring means, said apparatus being designed to execute original scanning as an original glass plate is moved with respect to said main body, characterized in comprising a reflecting unit for reflecting the light from the light source to illuminate the surface of the photoreceptor at an area between the charging means and the developing means, said reflecting unit being disposed at a position corresponding to the leading end of the original glass plate in its forward movement for original scanning, and control means for causing the original glass plate to stop at an original scanning starting station prior to the start of the original scanning and for causing the light source to emit light so that the charge which is applied to a non-image area of the photoreceptor surface until the start of the original scanning is removed by the light from the light source that is reflected by said reflecting unit to illuminate the surface of the photoreceptor, thereby cleaning the photoreceptor.

* * * * *

UNITED STATES PATENT AND TRADEMARK OFFICE

CERTIFICATE OF CORRECTION

PATENT NO. : 4,920,379

DATED : April 24, 1990

INVENTOR(S) : Yasushi Nakanishi, et al.

It is certified that error appears in the above-identified patent and that said Letters Patent is hereby corrected as shown below:

ON THE TITLE PAGE,
IN THE ABSTRACT:

Line 2, before "charging" add --a--.

Line 3, delete "a".

Signed and Sealed this

Ninth Day of July, 1991

*Attest:*

HARRY F. MANBECK, JR.

*Attesting Officer*

*Commissioner of Patents and Trademarks*